US010569433B1

(12) United States Patent
Wong

(10) Patent No.: US 10,569,433 B1
(45) Date of Patent: Feb. 25, 2020

(54) SAFETY CUTTER

(71) Applicant: Tsang Wing Wong, Kowloon (HK)

(72) Inventor: Tsang Wing Wong, Kowloon (HK)

( * ) Notice: Subject to any disclaimer, the term of this patent is extended or adjusted under 35 U.S.C. 154(b) by 0 days.

(21) Appl. No.: 16/120,321

(22) Filed: Sep. 3, 2018

(51) Int. Cl.
*B26B 1/08* (2006.01)
*B26B 5/00* (2006.01)

(52) U.S. Cl.
CPC ..... *B26B 5/003* (2013.01); *B26B 1/08* (2013.01)

(58) Field of Classification Search
CPC ..... B26B 1/08; B26B 1/10; B26B 5/001–003
USPC ..... 30/162, 320
See application file for complete search history.

(56) References Cited

U.S. PATENT DOCUMENTS 158,830 A * 1/1875 Buterworth ..... B26B 5/006 30/162
253,185 A * 2/1882 Christlmiller ..... B26B 5/006 30/162
568,249 A * 9/1896 Hart ..... A45D 29/02 30/162
1,406,156 A * 2/1922 Cotter et al. ..... B29C 73/26 30/162
1,411,649 A * 4/1922 Vincent ..... B26B 1/08 30/163
1,453,897 A * 9/1923 Vincent ..... B26B 1/08 30/163
1,755,535 A * 4/1930 Bratrud ..... B26B 27/00 30/162
1,833,406 A * 11/1931 Bratrud ..... B26B 1/08 30/162
2,061,669 A * 11/1936 Orman ..... B27G 17/04 30/171
2,512,237 A * 6/1950 Mravik ..... B26B 1/08 30/151
2,885,779 A * 5/1959 Newkirk ..... B26B 1/08 30/162
3,967,377 A * 7/1976 Wells ..... B26B 1/08 30/338
4,054,294 A * 10/1977 Wells ..... B26B 1/08 279/44
4,240,202 A * 12/1980 Gilbert ..... B26B 5/002 30/162
5,207,696 A * 5/1993 Matwijcow ..... A61B 17/3211 30/151

(Continued)

FOREIGN PATENT DOCUMENTS

DE 202011050068 U1 * 8/2011 ..... B26B 5/001
WO WO-2018134751 A1 * 7/2018 ..... B26B 29/02

*Primary Examiner* — Jason Daniel Prone

(57) ABSTRACT

The safety cutter supports adjustment of the blade length which is allowed to expose outside the housing. It includes a housing, a blade carrier, a blade, a threaded shaft, a nut and a guiding member. The blade carrier is slidable along a blade carrier track provided within the housing. The blade removably engages a forward end of the blade carrier. The threaded shaft is disposed along the blade carrier track. The nut is restricted from axial rotation and engaged with the threaded shaft in such a way that rotation of the threaded shaft drives the nut to move axially along the threaded shaft. The guiding member is fixedly coupled to the blade carrier for guiding movement of the blade carrier and positioned to be movable between a rear end of the blade carrier track and the nut.

8 Claims, 2 Drawing Sheets

(56) References Cited

U.S. PATENT DOCUMENTS 5,665,099 A * 9/1997 Pilo ..... A61B 17/3211 30/162
5,906,050 A * 5/1999 Gilbert ..... B26B 5/002 30/162
5,966,817 A * 10/1999 Lee ..... B26B 5/001 30/162
6,484,404 B1 * 11/2002 Kao ..... B26B 5/002 30/162
6,623,499 B1 * 9/2003 Andreini ..... A61B 17/3211 30/335
6,796,033 B2 * 9/2004 Owoc ..... B26B 5/001 30/162
6,810,781 B2 * 11/2004 Peters ..... B23D 35/008 83/581
7,178,244 B2 * 2/2007 Fossella ..... B26B 5/00 30/162
7,621,051 B2 * 11/2009 Ping ..... B26B 5/00 30/162
D668,525 S * 10/2012 Huang ..... D8/99
8,413,339 B2 * 4/2013 Ranieri ..... B26B 5/002 30/162
8,819,943 B2 * 9/2014 Maxwell ..... A61B 17/3211 30/162
8,997,358 B2 * 4/2015 Huang ..... B26B 1/08 30/162
9,409,299 B2 * 8/2016 Segler ..... B26B 5/002
2009/0235533 A1 * 9/2009 Huang ..... B26B 5/00 30/162
2010/0199501 A1 * 8/2010 Hernandez ..... B26B 5/001 30/162
2011/0283543 A1 * 11/2011 Wu ..... B26B 5/001 30/162
2014/0165409 A1 * 6/2014 Scimone ..... B26B 5/003 30/162
2014/0182140 A1 * 7/2014 Rosenhan ..... B26B 5/003 30/162
2016/0167239 A1 * 6/2016 Gallegos ..... B26B 5/001 30/162

* cited by examiner

SAFETY CUTTER

BACKGROUND OF THE INVENTION

The present invention relates to a safety cutter and more specifically pertains to a safe cutter which supports adjustment of the blade length allowed to expose outside the housing.

Safety cutters are widely available in the marketplace. To use a conventional safety cutter, the user is required to slide a blade carrier forward to expose the blade outside the housing. For example, if a user needs to cut open cut open a number of substantially identical carton boxes to unload the goods therein, the user is required to carefully slide the blade carrier forward for a certain distance to expose the blade. The distance could not be too long so that the blade may penetrate the carton box to damage the goods therein, and could not be too short so that the blade could not cut open the carton box. As it is dangerous to let the blade expose out of the cutter when the cutter is not in use (e.g. when moving the goods in the carton box to another place), the user has to retract the blade when the cutter is not in use, and to carefully slide the blade carrier forward for the certain distance every single time after he retracts the blade, which make the task cumbersome and tiring.

BRIEF SUMMARY OF THE INVENTION

In view of the aforesaid disadvantages now present in the prior art, the object of the present invention is to provide a safety cutter which supports adjustment of the blade length allowed to expose outside the housing.

To attain this, the safety cutter of the present invention comprises:

a housing;

a blade carrier slidable along a blade carrier track provided within the housing;

a blade which removably engages a forward end of the blade carrier;

a threaded shaft disposed along the blade carrier track;

a nut restricted by a rotation restricting means from axial rotation and engaged with the threaded shaft in such a way that rotation of the threaded shaft drives the nut to move axially along the threaded shaft; and a guiding member fixedly coupled to the blade carrier for guiding movement of the blade carrier and positioned to be movable between a rear end of the blade carrier track and the nut.

In one embodiment, the rotation restricting means is in form of a groove for the nut to move axially therealong; the groove is defined between two sidewalls which extend downward from the blade carrier into the blade carrier track; the groove has a width which restricts the nut from axial rotation while allows axial translation of the nut.

In one embodiment, the nut has a cross-section in shape of a hexagon; the nut is positioned in the groove in such a way that two parallel sides of the hexagon align with the two sidewalls of the groove.

In one embodiment, a rotatable knob is operatively engaged with a rear end of the threaded shaft.

In one embodiment, the housing comprises a main housing and a track frame; the track frame has a frame sidewall with a sliding slot for the guiding member of the blade carrier to slide along, and a shaft receiving member for receiving the threaded shaft. The track frame sleeves into the main housing so that only a rear end thereof is exposed. The rear end of the track frame provides an opening which accommodates the rotatable knob. The main housing is provided with a plurality of slots on its bottom side which provide visual access to the nut.

In one embodiment, a coil spring is provided within the housing; the coil spring has a rear end which is fixedly coupled to the housing at a rear portion of the blade carrier track and a front end which is fixedly coupled to the blade carrier; the coil spring is adapted to bias the blade carrier towards the rear end of the blade carrier track.

DETAILED DESCRIPTION OF THE INVENTION

The present invention is further described in detail with the following embodiment and the accompanying drawings.

Figure 1:
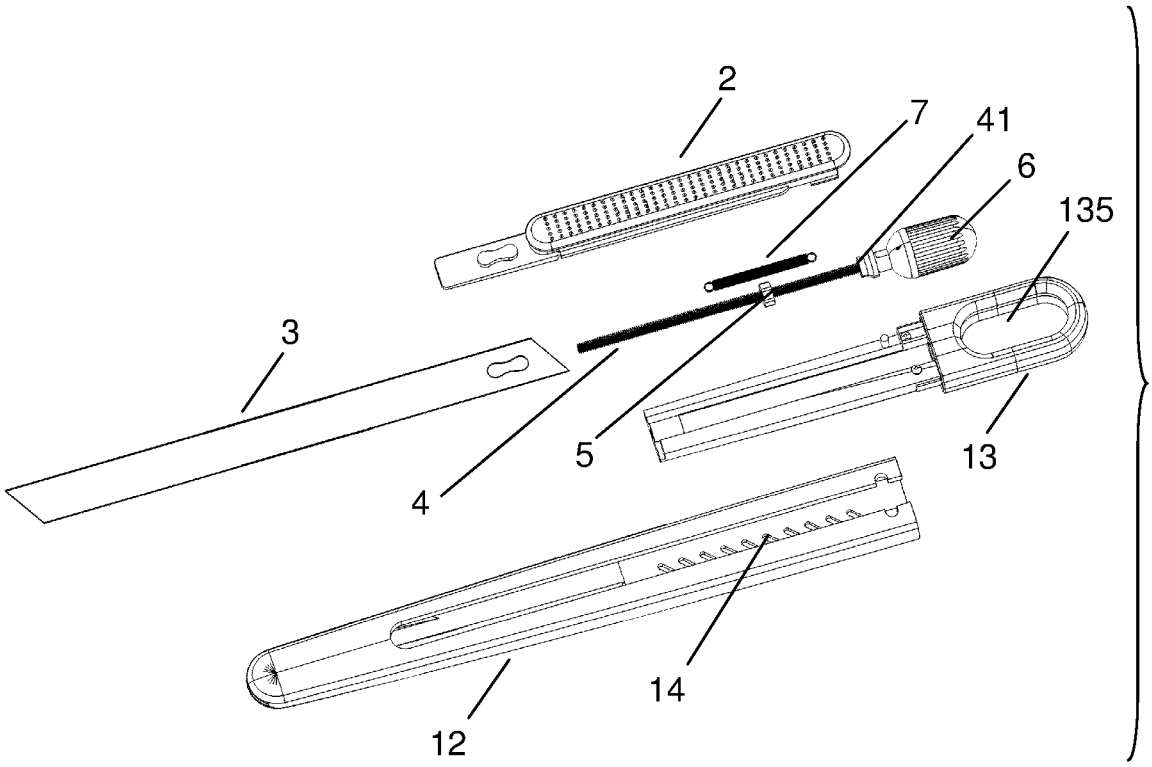
FIG. 1 is an exploded view of a preferred embodiment of the present invention.
Figure 2:
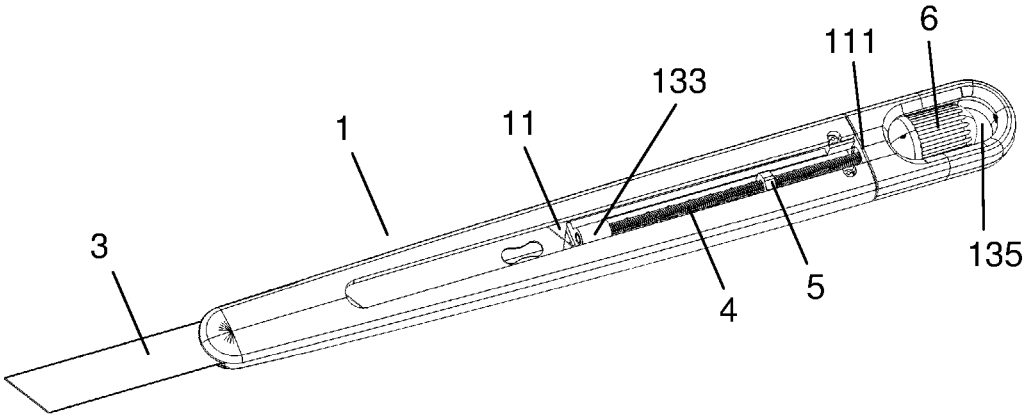
FIG. 2 is a perspective view of the embodiment as shown in FIG. 1 with the blade carrier removed.
Figure 3:
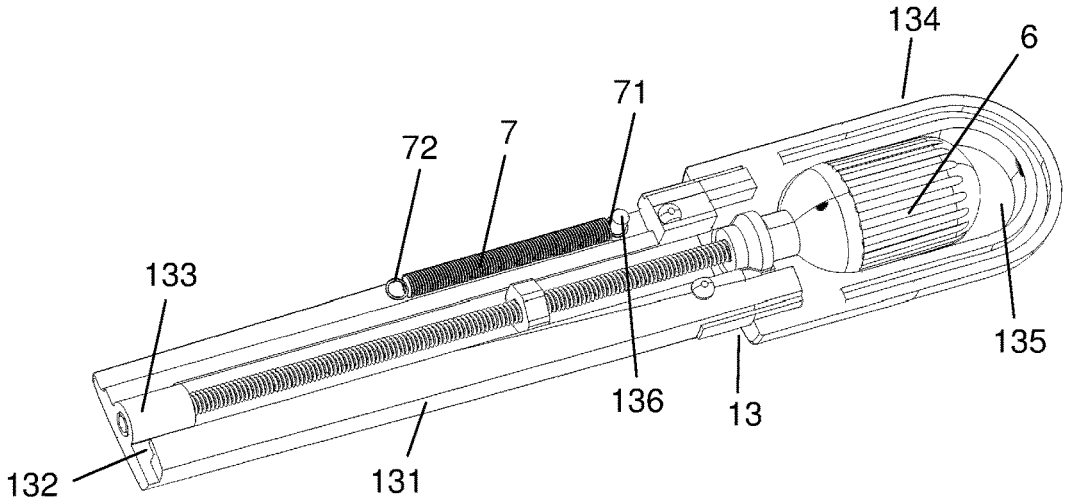
FIG. 3 is a perspective view showing the threaded shaft, the nut and the coil spring as engaged with the track frame (partially shown) of the embodiment a shown in FIG. 1.
Figure 4:
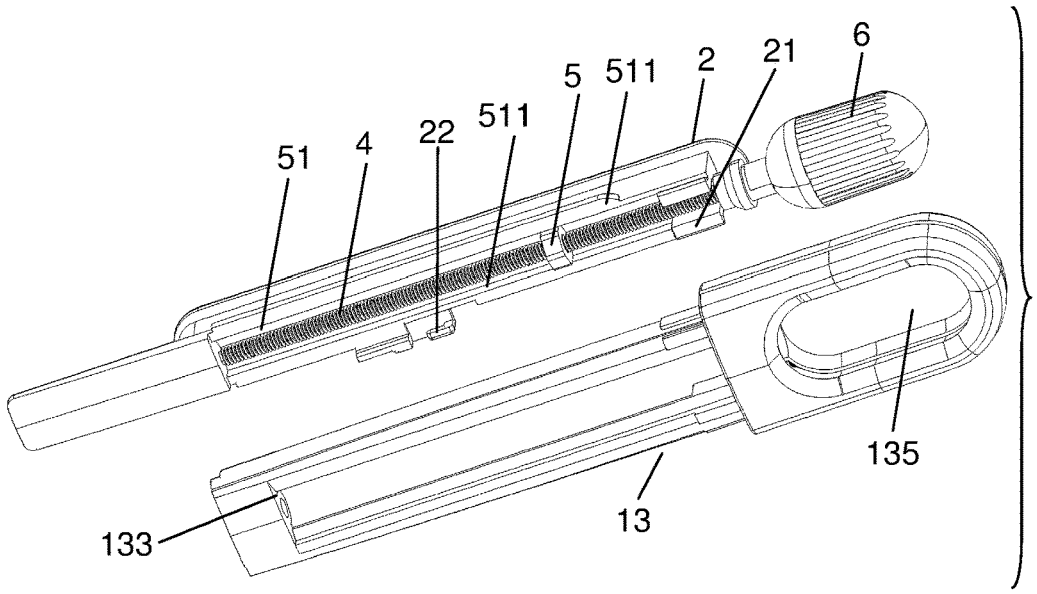
FIG. 4 is a perspective bottom view of the embodiment as shown in FIG. 1 showing the blade carrier, the threaded shaft, the nut, the rotatable knob and the track frame.
Figure 5:
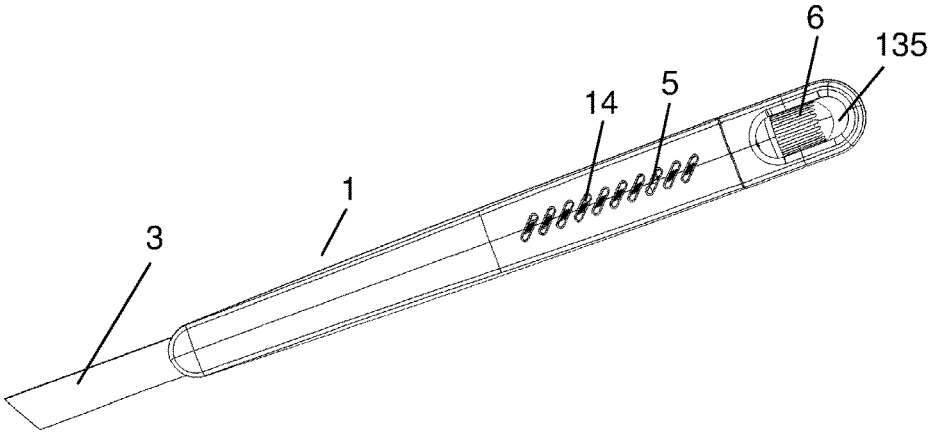
FIG. 5 is a perspective view of the embodiment as shown in FIG. 1.

As illustrated in FIGS. 1-5, a preferred embodiment of the safe cutter of the present invention comprises a housing 1, a blade carrier 2, a blade 3, a threaded shaft 4 and a nut 5. The blade carrier 2 is slidable along a blade carrier track 11 provided within the housing 1. The blade 3 removably engages a forward end of the blade carrier 2. The threaded shaft 4 is disposed along the blade carrier track 11. The nut 5 is restricted by a rotation restricting means 51 from axial rotation and is engaged with the threaded shaft 4 in such a way that rotation of the threaded shaft 4 drives the nut 5 to move axially along the threaded shaft 4. A guiding member 21 is fixedly coupled to the blade carrier for guiding movement of the blade carrier and is positioned to be movable between a rear end 111 of the blade carrier track 11 and the nut 5.

In this embodiment, the rotation restricting means 51 is in form of a groove for the nut 5 to move axially therealong. The groove forming the rotation restricting means 51 is defined between two sidewalls 511 which extend downward from the blade carrier 2 into the blade carrier track 11. The groove forming the rotation restricting means 51 has a width which restricts the nut 5 from axial rotation while allows axial translation of the nut 5.

In this embodiment, the nut 5 has a cross-section in shape of a hexagon. The nut 5 is positioned in the groove forming the rotation restricting means 51 in such a way that two parallel sides of the hexagon align with the two sidewalls 511 of the groove.

In one embodiment, a rotatable knob 6 is operatively engaged with a rear end 41 of the threaded shaft 4. The housing 1 comprises a main housing 12 and a track frame 13. The track frame 13 has a frame sidewall 131 with a sliding slot 132 for the guiding member 21 of the blade carrier 2 to slide along, and a shaft receiving member 133 for receiving the threaded shaft 4. The track frame 13 sleeves into the main housing 12 so that only a rear end 134 thereof is exposed. The rear end 134 of the track frame 13 provides an opening 135 which accommodates the rotatable knob 6. The main housing 1 is provided with a plurality of slots 14 on its bottom side which provide visual access to the nut 5.

The safety cutter of the present embodiment supports adjustment of the blade length allowed to expose outside the housing 1. The distance between the rear end 111 of the blade carrier track 11 and the nut 5 defines the length of the blade 3 allowed to expose outside the housing 1. When the user wishes to increase the blade length allowed to expose outside the housing, the user rotates the rotatable knob 6 towards a first direction, thereby driving rotation of the threaded shaft 4 towards the first direction. As the nut 5 is restricted by the rotation restricting means 51 from axial rotation, the nut 5 is forced to move axially along the threaded shaft 4 forward, thereby increasing the distance between the rear end 111 of the blade carrier track 11 and the nut 5. The guiding member 21 of the blade carrier 2 is therefore allowed to move forward for a longer distance, thus guiding the blade carrier 2 to move forward for a longer distance to expose a longer length of the blade 3 outside the housing 1. When the user wishes to decrease the blade length allowed to expose outside the housing, the user rotates the rotatable knob 6 towards a second direction, thereby driving rotation of the threaded shaft 4 towards the second direction. As the nut 5 is restricted by the rotation restricting means 51 from axial rotation, the nut 5 is forced to move axially along the threaded shaft 4 rearward, thereby decreasing the distance between the rear end 111 of the blade carrier track 11 and the nut 5. The guiding member 21 of the blade carrier 2 is therefore allowed to move forward for a shorter distance, thus guiding the blade carrier 2 to move forward for a shorter distance to expose a shorter length of the blade 3 outside the housing 1.

The safety cutter of the present embodiment also supports automatic retraction of the blade 3 by providing a coil spring 7 within the housing 1. The coil spring 7 has a rear end 71 which is fixedly coupled to the housing 1 at a rear portion of the blade carrier track 11 and a front end 72 which is fixedly coupled to the blade carrier 2. In this embodiment, the rear end 71 of the coil spring 7 is mounted to a stud 136 provided at a rear portion of the track frame 13. The front end 72 of the coil spring 7 is hooked to a hook 22 extended from a middle bottom portion of the blade carrier 2. The coil spring 7 is adapted to bias the blade carrier 2 towards the rear end 111 of the blade carrier track 11. When the blade carrier 2 is at the rear end 111 of the blade carrier track 11, the coil spring 7 is at a fully unloaded state. When the user slides the blade carrier 2 forward to expose the blade 3 out of the housing 1, the coil spring 7 is extended against its restoration force. When the user releases the blade carrier 2, the coil spring 7 automatically rebounds to the fully unloaded state by its restoration force.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A safety cutter comprising a housing which receives a blade carrier comprising a rotation restricting means, a blade, a threaded shaft, a nut, and a guide member therein;

the blade carrier is slidable in a blade carrier track provided within the housing;

the blade removably engages a forward end of the blade carrier;

the threaded shaft is disposed in the blade carrier track;

the nut engages with the blade carrier; the nut slides in the rotation restricting means; the nut is restricted by the rotation restricting means from axial rotation and is engaged with the threaded shaft in such a way that rotation of the threaded shaft drives the nut to move axially along the threaded shaft in the rotation restricting means and relative to the rotation restricting means; movement of the nut moves the blade carrier; and the guiding member is fixedly coupled to the blade carrier for guiding movement of the blade carrier in cooperation with the housing, and the guiding member is positioned to be movable between a rear end of the blade carrier track and the nut.

2. The safety cutter as in claim 1, wherein the rotation restricting means is in form of a groove for the nut to move axially therein the groove is defined between two sidewalls which extend downward from the blade carrier into the blade carrier track; the sidewalls engage with the nut to restrict the nut from axial rotation while allows axial translation of the nut.

3. The safety cutter as in claim 2, wherein the nut has a cross-section in shape of a hexagon; the nut is positioned in the groove in such a way that two parallel sides of the hexagon align and engage with the two sidewalls of the groove.

4. The safety cutter as in claim 1, wherein a rotatable knob is received by the housing and operatively engaged with a rear end of the threaded shaft.

5. The safety cutter as in claim 4, wherein the housing comprises a main housing and a track frame; the track frame has a frame sidewall with a sliding slot for the guiding member of the blade carrier to slide therein, and a shaft receiving member for receiving the threaded shaft; the frame sidewall, the sliding slot and the shaft receiving member are received in the main housing to partially define the blade carrier track.

6. The safety cutter as in claim 5, wherein a rear end of the track frame is exposed from the main housing; the rear end of the track frame provides an opening; the rotatable knob is accommodated in the opening.

7. The safety cutter as in claim 5, wherein the main housing has a first side which is opposite to the blade carrier; the first side of the main housing is provided with a plurality of slots thereon for providing visual access to the nut.

8. The safety cutter as in claim 1, wherein a coil spring is provided within the housing; the coil spring has a rear end which is fixedly coupled to the housing at a position near to the rear end of the blade carrier track and a front end which is fixedly coupled to the blade carrier; the coil spring is adapted to bias the blade carrier towards the rear end of the blade carrier track.

* * * * *